US012157980B2

(12) United States Patent
Han et al.

(10) Patent No.: US 12,157,980 B2
(45) Date of Patent: Dec. 3, 2024

(54) ALGAE COLLECTION DEVICE USING ESCALATOR-TYPE LIFT

(71) Applicant: SEOUL NATIONAL UNIVERSITY R&DB FOUNDATION, Seoul (KR)

(72) Inventors: Moo-Young Han, Gyeonggi-do (KR); Tschung-Il Kim, Seoul (KR); Hyun-Ju Park, Seoul (KR)

(73) Assignee: SEOUL NATIONAL UNIVERSITY R&DBFOUNDATION, Seoul (KR)

( * ) Notice: Subject to any disclaimer, the term of this patent is extended or adjusted under 35 U.S.C. 154(b) by 537 days.

(21) Appl. No.: 17/595,114

(22) PCT Filed: May 27, 2020

(86) PCT No.: PCT/KR2020/006831
§ 371 (c)(1),
(2) Date: Nov. 9, 2021

(87) PCT Pub. No.: WO2020/242186
PCT Pub. Date: Dec. 3, 2020

(65) Prior Publication Data

US 2022/0213660 A1 Jul. 7, 2022

(30) Foreign Application Priority Data

May 27, 2019 (KR) ..... 10-2019-0062026

(51) Int. Cl.
*E02B 15/10* (2006.01)

(52) U.S. Cl.
CPC ..... *E02B 15/104* (2013.01); *E02B 15/103* (2013.01)

(58) Field of Classification Search
CPC ..... E02B 15/10; E02B 15/104; B01D 21/2455; B01D 21/2433; B01D 21/2438
See application file for complete search history.

(56) References Cited

U.S. PATENT DOCUMENTS

2006/0237362 A1* 10/2006 Weymouth ..... B01D 21/02 210/299

FOREIGN PATENT DOCUMENTS

| | | | |
|---|---|---|---|
| KR | 20020037085 | A | 5/2002 |
| KR | 20100022543 | A | 3/2010 |
| KR | 101371405 | B1 | 3/2014 |
| KR | 101486040 | B1 | 1/2015 |
| KR | 101575765 | B1 | 12/2015 |

OTHER PUBLICATIONS

International Search Report and Written Opinion dated Sep. 28, 2020, for corresponding PCT Application No. PCT/KR2020/006831.

* cited by examiner

*Primary Examiner* — Pranav N Patel
(74) *Attorney, Agent, or Firm* — Kinney & Lange P.A.

(57) ABSTRACT

The present invention relates to an algae collection device and, in particular, to an algae collection device using an escalator-type lift equipped with a screen having a level state. The present invention may collect algae using an escalator-type lift equipped with a screen having a level state while the algae do not move down. The present invention may effectively collect, into a collection box, the algae transported on the escalator-type lift by means of compressed air generated by a compressor.

3 Claims, 3 Drawing Sheets

ALGAE COLLECTION DEVICE USING ESCALATOR-TYPE LIFT

CROSS-REFERENCE TO RELATED APPLICATION(S)

This application is the national phase of PCT Application No. PCT/KR2020/006831 filed on May 27, 2020, which in turn claims priority to Korean Application No. 10-2019-0062026 filed on May 27, 2019, both of which are incorporated by reference herein in their entireties.

BACKGROUND

Technical Field

The present disclosure relates to an algae collection apparatus, in particular, to an algae collection apparatus using an automatic escalator-type lift equipped with a screen having a level state.

Description of Related Art

Algae are lower cryptogam and multiply using spores in water and perform anabolism using chlorophyll. The algae may multiply greatly depending on conditions such as temperature. This threatens survival of other aquatic organisms due to decrease in oxygen saturation in water. Therefore, many methods for removing the algae have been developed and used. Currently, schemes for algae removal are largely divided into air-based flotation, pollutant inflow restriction, clay spraying, hydration fence, aquatic life-based method, chemical treatment, and low soil treatment (dredging). The algae removal using the air-based flotation generally involves floating the algae using air bubbles and then collecting the algae with a scraper or conveyor. However, this conventional algae collection scheme has a problem in that the algae collection efficiency is not high.

SUMMARY

A purpose of the present disclosure is to provide an algae collection apparatus with high algae collection efficiency.

Purposes of the present disclosure are not limited to the above-mentioned purpose. Other purposes and advantages of the present disclosure that are not mentioned above may be understood based on following descriptions, and will be more clearly understood with reference to embodiments of the present disclosure. Further, it will be readily apparent that the purposes and advantages of the present disclosure may be realized using means and combinations thereof indicated in the Claims.

The present disclosure provides an algae collection apparatus using an automatic escalator-type lift, wherein the apparatus has one end located in water and an opposite end located above a water surface and is configured to collect floating matter including algae on a water surface, wherein the apparatus includes: a plurality of lifts connected to each other in an escalator manner, wherein each lift includes: a screen for lifting up the floating matter from the water surface into a space above the surface; a guide for supporting an edge of the screen; and a riser for levelling the screen using elasticity; a chain for moving the plurality of lifts; and a driver for driving the plurality of lifts via the chain.

The apparatus may further include an algae collector disposed at the opposite end for pushing the floating matter out of the lift.

The algae collector may include a roll-type brush.

The algae collection apparatus may further include: a compressor for generating compressed air; and a compressed air ejection nozzle for ejecting the compressed air generated from the compressor onto the lift disposed at the opposite end.

The algae collection apparatus using the automatic escalator-type lift according to the present disclosure may collect the algae using the automatic escalator-type lift with the screen having a level state while the algae does not fall down.

Further, the algae collection apparatus using the automatic escalator-type lift according to the present disclosure may effectively collect the transferred algae from the automatic escalator-type lift using the compressed air generated by the compressor.

The above-described effects, and specific effects of the present disclosure as not mentioned above will be described based on specific details for carrying out the disclosure.

DETAILED DESCRIPTION

Figure 1:
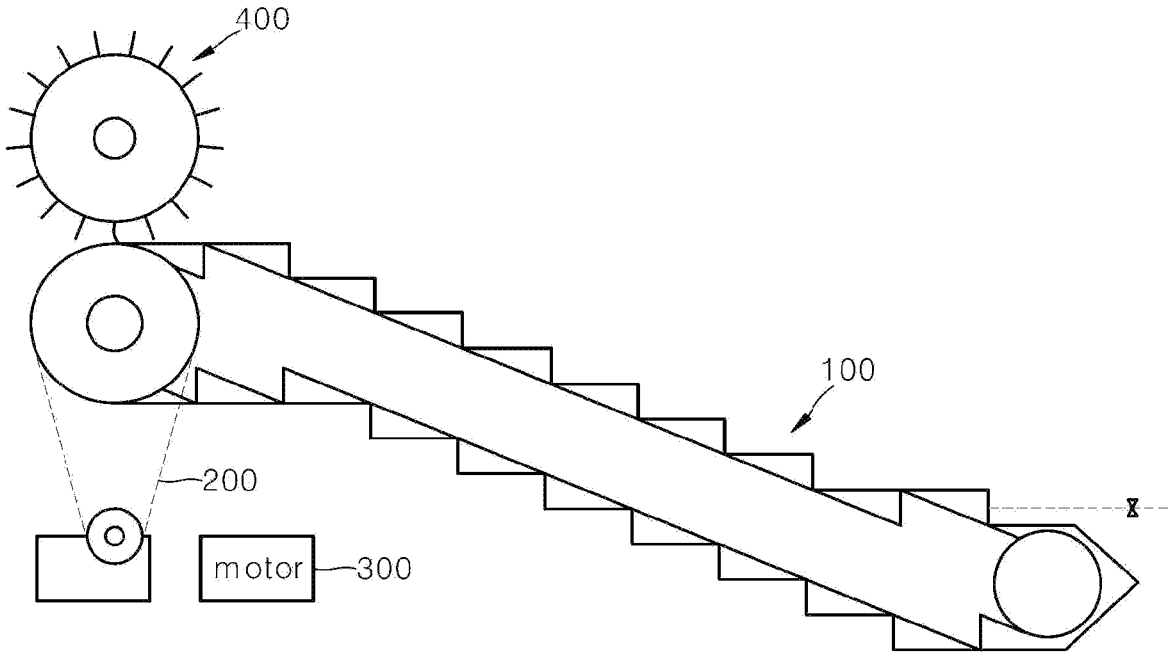
FIG. 1 is a conceptual diagram of an algae collection apparatus using an automatic escalator-type lift according to the present disclosure.

The above objects, features and advantages will be described in detail later with reference to the accompanying drawings. Accordingly, a person with ordinary knowledge in the technical field to which the present disclosure belongs will be able to easily implement the technical idea of the present disclosure. In describing the present disclosure, when it is determined that a detailed description of a known component related to the present disclosure may unnecessarily obscure gist the present disclosure, the detailed description is omitted. Hereinafter, a preferred embodiment according to the present disclosure will be described in detail with reference to the accompanying drawings. In the drawings, the same reference numerals are used to indicate the same or similar elements.

FIG. 1 is a conceptual diagram of an algae collection apparatus using an automatic escalator-type lift according to the present disclosure.

An algae collection apparatus 100 using an automatic escalator-type lift according to the present disclosure includes an automatic escalator-type lift 100 that transports algae floating on a water surface, a belt 200 for driving the automatic escalator-type lift 100, a driver 300 for driving a chain 120, and an algae collector 400 for collecting the algae from the automatic escalator-type lift 100 in a pushing manner, as shown in FIG. 1 Further, although not shown, the apparatus according to the present disclosure may further include an algae collection box for collecting and accommodating the transferred algae from the automatic escalator-type lift 100.

Figure 2:
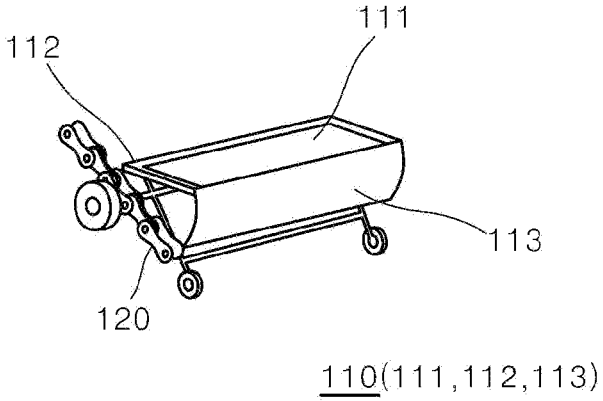
FIG. 2 is a schematic perspective view of an automatic escalator-type lift according to the present disclosure.

FIG. 2 is a schematic perspective view of an automatic escalator-type lift according to the present disclosure.

The automatic escalator-type lift 100 transports the algae in water to a surface of the water. For this purpose, the automatic escalator-type lift 100 includes a lift 110 including a screen 111 that directly lifts the algae, a guide 112 that supports an edge of the screen 111, and a riser 113 that maintains an angle of the screen 111, and a chain 120 that moves the lift 110.

The lift 110 refers to a minimum unit constituting the automatic escalator-type lift 100 according to the present disclosure. The apparatus according to the present disclosure includes a plurality of lifts 110 which are arranged in an escalator manner, and the chain 120 which moves the lifts 110 such that the lifts 110 operates as an escalator. The screen 111 as the element constituting the lift 110 has a form of a mesh. A portion of the water contained in the algae raised up to the water surface and water raised up together with the algae are discharged downward through the screen. The screen 111 in the mesh form may be deformed due to a weight of the algae. Therefore, according to the present disclosure, the deformation of the screen 111 may be prevented by providing the guide 112 that surrounds the edge of the screen 111. In another example, the screen 111 has a sufficient rigidity such that the guide 112 may be omitted. The screen 111 and the guide 112 may be removably coupled to each other via fastening bolts, etc. The riser 113 maintains an angle of the screen 111 whose the edge is surrounded with the guide 112. In accordance with the present disclosure, the screen 111 should be kept to have a level state. That is, when the screen 111 is not kept to have the level state, it is difficult to effectively collect the algae. Therefore, according to the present disclosure, the riser 113 levels the screen 111 using elasticity. For this purpose, the riser 113 may be embodied as a thin plate spring. Thus, when downward pressure is applied to the screen 111, the screen 111 is kept to have the level state. In another example, a considerable pressure is applied to the screen 111 such that the screen 111 is damaged. Thus, the riser 113 may be flexible to prevent the screen 111 from being damaged The belt 200 receives power from the driver 300 to operate the automatic escalator-type lift 100. The belt 200 may use a general rubber belt 200 or a chain 120. However, the present disclosure is not limited thereto. Gear type transmission means may be used instead of the belt 200.

The driver 300 is connected to the belt 200 to rotate the belt 200. This driver 300 may include an electric motor operated by electricity or an engine operated by fuel.

Figure 3:
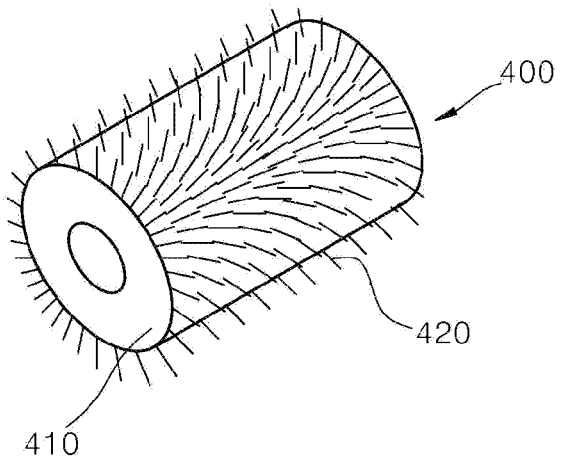
FIG. 3 is a perspective view of an algae collector in an algae collection apparatus using an automatic escalator-type lift according to the present disclosure.

FIG. 3 is a perspective view of an algae collector in an algae collection apparatus using an automatic escalator-type lift according to the present disclosure.

The algae collector 400 collects the transferred algae from the automatic escalator-type lift 100. This algae collector 400 is embodied as a roll-shaped brush. Accordingly, the algae collector 400 is configured so that a brush is in contact with the automatic escalator-type lift 100 and hooks and sweeps down the transferred algae from the automatic escalator-type lift 100 by rotation. In another example, the brush is shortened due to wear, etc., and thus a spacing between the brush and the automatic escalator-type lift 100 may be reduced. When the brush is replaced with a new brush, a spacing between the algae collector 400 and the automatic escalator-type lift 100 is increased. To this end, a spacing between the automatic escalator-type lift 100 and the collector 400 is adjustable.

As described above, the apparatus according to the present disclosure may collect the algae using the automatic escalator-type lift with the screen having a level state while the algae does not fall down.

In one example, this embodiment exemplifies that the algae collector 400 includes the roll-type brush. The present disclosure is not limited thereto. In one example, the algae may be collected using a compressor that generates compressed air and an ejector which ejects the compressed air generated by the compressor to the automatic escalator-type lift 100.

Figure 4:
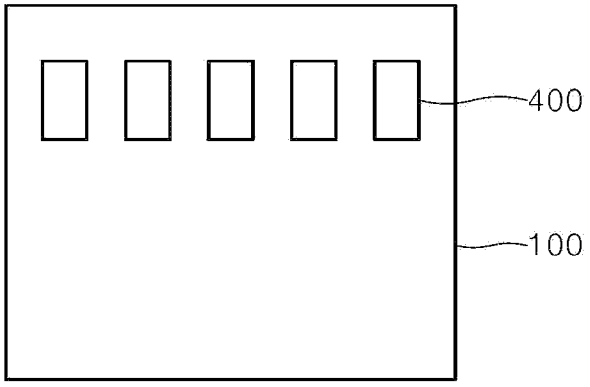
FIG. 4 is a plan view for illustrating a compressed air ejection nozzle in an algae collection apparatus using an automatic escalator-type lift according to the present disclosure.

FIG. 4 is a plan view for illustrating a compressed air ejection nozzle in an algae collection apparatus using an automatic escalator-type lift according to the present disclosure.

A compressed air ejection nozzle 400 ejects the compressed air supplied from the compressor to the algae which is being transported on the automatic escalator-type lift 100. A plurality of compressed air ejection nozzles 400 may be provided. In this case, as shown in FIG. 4, the plurality of compressed air ejection nozzles 400 may be arranged in a line and on the automatic escalator-type lift 100 may be spaced apart from each other by a predetermined spacing. Accordingly, the transported algae on the automatic escalator-type lift 100 is pushed up and collected by the compressed air ejected from the plurality of compressed air ejection nozzles 400 into the algae collection box.

Figure 5:
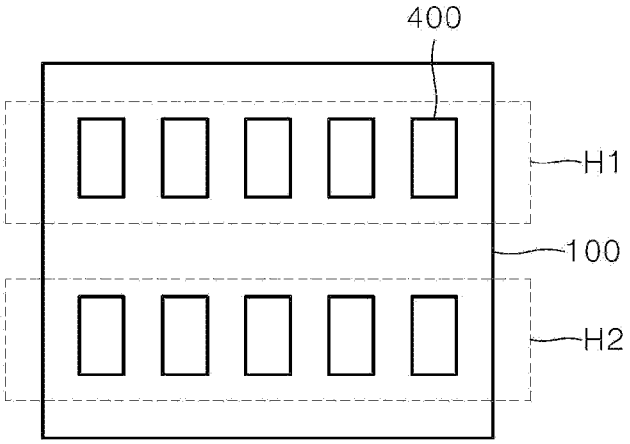
FIG. 5 is a plan view for illustrating a modified example of a compressed air ejection nozzle in an algae collection apparatus using an automatic escalator-type lift according to the present disclosure.

FIG. 5 is a plan view for illustrating a modified example of the compressed air ejection nozzle in the algae collection apparatus using an automatic escalator-type lift according to the present disclosure.

In one example, the compressed air ejection nozzles 400 according to the present disclosure may be arranged in a line and on the automatic escalator-type lift 100 may be spaced apart from each other by a predetermined spacing. A plurality of compressed air ejection nozzles 400 spaced apart from each other by a predetermined distance and arranged in one line constitute one compressed air ejection nozzle group. A plurality of the compressed air ejection nozzle groups are arranged. As shown in FIG. 5, a first compressed air ejection nozzle group H1, and a second compressed air ejection nozzle group H2 may be arranged and may be spaced apart from each other by a predetermined distance. In another example, two or more compressed air ejection nozzle groups may be arranged.

A compressed air ejection force of the first compressed air ejection nozzle group H1 is the greatest, and the compressed air ejection force of the second compressed air ejection nozzle group H2 is the second greatest, the compressed air ejection force of a third compressed air ejection nozzle group H2 is the third greatest, and so on. This is because when the strongest compressed air is first ejected to the algae, the algae are scattered. In accordance with the present disclosure, the compressed air is first ejected at a weak ejection force toward the algae such that the algae are displaced little by little toward the algae collection box, and then the compressed air is ejected at strong ejection force toward the algae such that the algae is finally received in the algae collection box.

Figure 6:
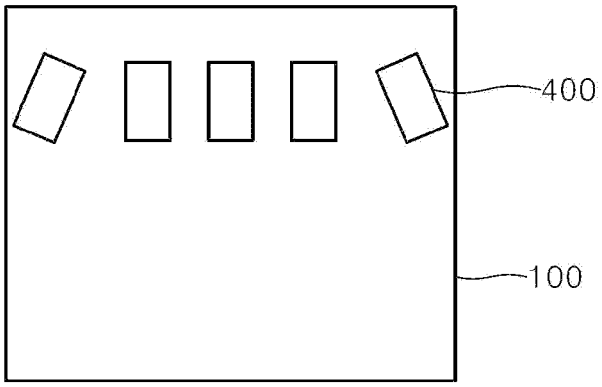
FIG. 6 is a plan view for illustrating another modified example of a compressed air ejection nozzle in an algae collection apparatus using an automatic escalator-type lift according to the present disclosure.

FIG. 6 is a plan view for illustrating another modified example of the compressed air ejection nozzle in the algae collection apparatus using an automatic escalator-type lift according to the present disclosure.

In the above-described embodiment, all of the compressed air ejection directions of the compressed air ejection nozzles 400 are the same as a rotational direction of the automatic escalator-type lift 100. However, the present disclosure is not limited thereto. That is, as shown in FIG. 6, a compressed air ejection from the compressed air ejection nozzle 400 located at an edge of the lift 110 in the automatic escalator-type lift 100 is directed inwardly of the lift 110 in the automatic escalator-type lift 100. In this case, the algae located at the edge of the automatic escalator-type lift 100 may move toward a center of the automatic escalator-type lift 100, thereby preventing the algae from escaping from the edge of the automatic escalator-type lift 100. In another example, the compressed air ejection direction of the compressed air ejection nozzle 400 located at the edge of the lift as well as the compressed air ejection direction of the compressed air ejection nozzle 400 located at an inner region of the lift may be adjusted. For example, as a position of the compressed air ejection nozzle 400 changes from a center of the automatic escalator-type lift 100 to an edge thereof, the ejection direction of the compressed air ejection nozzle 400 may be gradually inclined toward a center of the automatic escalator-type lift 100. Moreover, the compressed air ejection nozzle 400 located at the edge of the automatic escalator-type lift 100 may be located closer to a bottom of the automatic escalator-type lift 100 in the plan view (FIG. 6) than the compressed air ejection nozzle 400 located at a non-edge position of the automatic escalator-type lift 100 may be. Thus, the compressed air ejected from the compressed air ejection nozzle 400 located at the edge of the automatic escalator-type lift 100 first reaches the algae transported on the automatic escalator-type lift 100.

As described above, the apparatus according to the present disclosure may effectively collect the algae transferred on the automatic escalator-type lift using the compressed air generated by the compressor into the algae collection box.

As described above, the present disclosure has been described with reference to the illustrated drawings. However, the present disclosure is not limited to the embodiments and drawings disclosed in the present specification. It is evident that various modifications may be made to the disclosure by those of ordinary skill in the art and within the scope of the technical idea of the present disclosure. In addition, although an effect of a configuration of the present disclosure has not been explicitly described above while illustrating the embodiments of the present disclosure, it is natural that an effect predictable from the configuration should also be appreciated.

What is claimed is:

1. An algae collection apparatus using an automatic escalator-type lift system, wherein the apparatus has one end located in water and an opposite end located above a water surface and is configured to collect floating matter including algae on the water surface and transport the collected floating matter including algae to an algae collection box located at the opposite end, wherein the apparatus comprises:

a plurality of lifts connected to each other in an escalator manner, wherein each lift of the plurality of lifts includes:

a screen for lifting up the floating matter from the water surface into a space above the surface;

a guide for supporting an edge of the screen; and a riser for levelling the screen using elasticity;

a chain for moving the plurality of lifts;

a driver for driving the plurality of lifts via the chain;

a compressor for generating compressed air; and a plurality of compressed air ejection nozzles for ejecting the compressed air generated from the compressor onto the lifts disposed at the opposite end, the plurality of compressed air ejection nozzles being arranged in a row and spaced apart from each other;

wherein the plurality of compressed air ejection nozzles are defined as a group of compressed air ejection nozzles, and a plurality of these groups are provided along the algae transport direction of the plurality of lifts, spaced apart from each other;

wherein an ejection force of the compressed air increases as the group of compressed air ejection nozzles approaches the algae collection box;

wherein an angle of the compressed air ejection nozzles increases progressively toward the center direction of the plurality of lifts as they move from the nozzles located at the center of the plurality of lifts toward the nozzles located at the edges of the plurality of lifts; and wherein the group of compressed air ejection nozzles closest to the plurality of lifts has the compressed air ejection nozzles located at the edges of the lifts positioned closer to the plurality of lifts than the other compressed air ejection nozzles, in the algae collection apparatus using the automatic escalator-type lift system.

2. The algae collection apparatus of claim 1, wherein the apparatus further comprises an algae collector disposed at the opposite end for pushing the floating matter out of a respective lift.

3. The algae collection apparatus of claim 2, wherein the algae collector includes a roll-type brush.

* * * * *